US011073328B1

(12) United States Patent
Akalan et al.

(10) Patent No.: US 11,073,328 B1
(45) Date of Patent: Jul. 27, 2021

(54) INJECTION MOLDED FRONT FRAME CORNERS FOR COOLING APPLIANCES

(71) Applicants: BSH Home Appliances Corporation, Irvine, CA (US); BSH Hausgeräte GmbH, Munich (DE)

(72) Inventors: Yigit Akalan, Tekirdag (TR); Howard Cheng, Laguna Woods, CA (US); Samuel Harward, Knoxville, TN (US); Cemalettin Hasturk, Knoxville, TN (US); Lucas Schulte Campos, Munich (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/750,022

(22) Filed: Jan. 23, 2020

(51) Int. Cl.
*F25D 23/06* (2006.01)
*F25D 23/02* (2006.01)

(52) U.S. Cl.
CPC ..... *F25D 23/067* (2013.01); *F25D 23/025* (2013.01); *F25D 23/069* (2013.01); *F25D 2201/12* (2013.01); *F25D 2323/021* (2013.01)

(58) Field of Classification Search
CPC ..... F25D 23/00; F25D 23/06; F25D 23/025; F25D 23/067; F25D 23/069
USPC ..... 312/401, 405, 406, 407
See application file for complete search history.

(56) References Cited

U.S. PATENT DOCUMENTS

| | | | | |
|---|---|---|---|---|
| 1,473,014 | A * | 11/1923 | Cohen | A47F 3/0421 62/379 |
| 2,160,221 | A | 5/1939 | Masters et al. | |
| 4,577,915 | A | 3/1986 | Nishida et al. | |
| 4,678,359 | A * | 7/1987 | Keen | A47B 47/0008 403/170 |
| 5,720,536 | A * | 2/1998 | Jenkins | F25D 23/085 312/401 |
| 5,899,546 | A | 5/1999 | Avendano et al. | |
| 6,655,766 | B2 | 12/2003 | Hodges | |
| 6,881,005 | B2 * | 4/2005 | Sosa | E06B 3/964 256/65.05 |
| 7,055,920 | B2 | 6/2006 | Leistner et al. | |
| 8,943,770 | B2 | 2/2015 | Sanders et al. | |
| 2010/0219732 | A1 * | 9/2010 | Gorz | F25D 23/064 312/405 |
| 2014/0055929 | A1 | 2/2014 | Sato et al. | |

* cited by examiner

*Primary Examiner* — James O Hansen
(74) *Attorney, Agent, or Firm* — Michael E. Tschupp; Andre Pallapies; Brandon G. Braun

(57) ABSTRACT

A refrigerator front frame for a refrigerator appliance, including: four profiles comprising two vertical profiles each having a first width and two horizontal profiles at least one of which has a second width, where the first width and the second width are different; and four corner connecting pieces configured to join the four profiles. Each of the four corner connecting pieces includes a horizontal receiving portion configured to receive one of the two horizontal profiles thereover and a vertical receiving portion configured to receive one of the two vertical profiles thereover. The ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and hidden from view.

24 Claims, 8 Drawing Sheets

INJECTION MOLDED FRONT FRAME CORNERS FOR COOLING APPLIANCES

FIELD OF THE INVENTION

The present disclosure relates generally to cooling appliances and to front frames for cooling appliances. More particularly, the present disclosure relates to injection molded front frame corners for a refrigerator appliance.

BACKGROUND OF THE INVENTION

In general, the front frame on traditional free standing refrigerators is often formed by wrapping the edges of the housing sides, top, and bottom over a thermoformed inner liner. This operation requires expensive and space intensive thermoforming equipment in the manufacturing facility. This method also limits the front frame color to the existing color of the inner liner and housing of the refrigerator. This solution also leaves an unappealing and unsightly seam that is visible when the door of the refrigerator appliance is opened.

Alternatively, the vertical and horizontal plastic front frame profiles can be used and joined at a 45 degree angle at each of the four corners to form a complete front frame for a refrigerator. This is also the standard method of producing plastic window frames or common wood or metal picture frames. However, this style of joining two frame profiles or members at 45 degrees only allows frame profiles having identical widths to be joined at the corners.

One method used for joining frame profiles of different widths is to use an additional exposed corner piece at each of the four corners. However, this method has a disadvantage in that the additional exposed corner pieces are now clearly visible from the front at each of the four corners when the frame profiles are assembled together to form a complete frame, such that the complete frame is not sleek and slim. In the final assembly, you end up with eight visible pieces instead of the four visible frame profiles that you would normally have with a standard frame where the frame profiles are joined at a 45 degree angle at the four corners.

Another method used for joining frame profiles of different widths has been used with the plastic frames of televisions (TVs) such as flat screen TVs where the two narrower width vertical frame profiles are joined to the two larger width horizontal profiles using a joint or joining line that has both an angled portion (e.g., 45 degrees) and a straight vertical portion. However, this method also results in a visible, oddly-shaped joining line at each corner of the complete frame.

SUMMARY OF THE INVENTION

An apparatus consistent with the present disclosure provides an apparatus and method for joining frame profiles of different widths at the corners, while at the same time minimalizing the number of unsightly seams or gaps, and avoiding the use of fully exposed or visible corner pieces or the use of visible, oddly-shaped joining lines at the four corners of a complete refrigerator front frame.

An apparatus consistent with the present disclosure provides a front frame having joining lines that are horizontal, vertical, or a mixture of both, and that are as slim as possible to match the industrial design of the overall cooling appliance.

An apparatus consistent with the present disclosure provides for strong, precise joining of extruded plastic profiles of a refrigerator front frame, while at the same time providing a clean, minimalist design configuration.

An apparatus consistent with the present disclosure allows for the elimination of a visible hinge step and creates a location for hiding the hinges, the door switch, and other mechanical or electrical components.

An apparatus consistent with the present disclosure also provides for the ability to set up configurations of multiple appliances positioned adjacent to each other.

According to one aspect, the present disclosure provides a refrigerator front frame for a refrigerator appliance, comprising: four profiles comprising two vertical profiles each having a first width and two horizontal profiles at least one of which has a second width, where the first width and the second width are different; and four corner connecting pieces configured to join the four profiles to form the refrigerator front frame, wherein each of the four corner connecting pieces comprises a horizontal receiving portion configured to receive one of the two horizontal profiles thereover and a vertical receiving portion configured to receive one of the two vertical profiles thereover, and wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view.

According to another aspect, the second width of the at least one of the two horizontal profiles is larger than the first width of each of the two vertical profiles.

According to another aspect, the at least one of the two horizontal profiles is a top horizontal profile of the refrigerator front frame of the refrigerator appliance.

According to another aspect, the horizontal receiving portion of each of the four corner connecting pieces includes an exposed end face with a flange that extends beyond the horizontal receiving portion and serves as a stop for the end of a corresponding horizontal profile.

According to another aspect, the horizontal receiving portion of each of the four corner connecting pieces includes an elongated slot configured to slidably receive a corresponding rail that projects from a rear surface of a corresponding horizontal profile.

According to another aspect, the vertical receiving portion of each of the four corner connecting pieces includes an elongated slot configured to slidably receive a corresponding rail that projects from a rear surface of a corresponding vertical profile.

According to another aspect, the at least one of the two horizontal profiles is a top horizontal profile of the refrigerator front frame of the refrigerator appliance, and wherein a lower side of the top horizontal profile is machined such that the top horizontal profile is slidable over the vertical receiving portion of a corresponding one of the four corner connecting pieces.

According to another aspect, each of the four corner connecting pieces is an injection molded plastic corner connecting piece.

According to another aspect, each of the four profiles is a plastic extrusion profile.

According to another aspect, the top horizontal profile of the refrigerator front frame of the refrigerator appliance is partitioned into a lower chamber that is foam-filled, and an upper chamber that is hollow to accommodate at least one of the following serviceable components: door hinges, a door switch, a wiring harness, an ambient light sensor, an open door assist, or other serviceable components.

According to another aspect, the top horizontal profile of the refrigerator front frame of the refrigerator appliance includes at least one service access opening along a top edge of the top horizontal profile in order to access the at least one of the serviceable components accommodated in the upper chamber.

According to another aspect, the present disclosure provides a cooling appliance including a front frame, the front frame comprising: four profiles comprising two vertical profiles each having a first width and two horizontal profiles at least one of which has a second width, where the first width and the second width are different; and four corner connecting pieces configured to join the four profiles to form a complete said front frame of the cooling appliance, wherein each of the four corner connecting pieces comprises a horizontal receiving portion configured to receive one of the two horizontal profiles thereover and a vertical receiving portion configured to receive one of the two vertical profiles thereover, and wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view.

According to another aspect, the second width of the at least one of the two horizontal profiles is larger than the first width of each of the two vertical profiles.

According to another aspect, the horizontal receiving portion of each of the four corner connecting pieces includes an exposed end face with a flange that extends beyond the horizontal receiving portion and serves as a stop for the end of a corresponding horizontal profile.

According to another aspect, the horizontal receiving portion of each of the four corner connecting pieces includes an elongated slot configured to slidably receive a corresponding rail that projects from a rear surface of a corresponding horizontal profile.

According to another aspect, the vertical receiving portion of each of the four corner connecting pieces includes an elongated slot configured to slidably receive a corresponding rail that projects from a rear surface of a corresponding vertical profile.

According to another aspect, each of the four corner connecting pieces is an injection molded corner connecting piece.

According to another aspect, each of the four profiles is a plastic extrusion profile.

According to another aspect, the at least one of the two horizontal profiles is a top horizontal profile of the front frame of the cooling appliance, and wherein the top horizontal profile of the front frame of the cooling appliance is partitioned into a lower chamber that is foam-filled, and an upper chamber that is hollow to accommodate at least one of the following serviceable components: door hinges, a door switch, a wiring harness, an ambient light sensor, an open door assist, or other serviceable components.

According to another aspect, the top horizontal profile of the front frame of the cooling appliance includes at least one service access opening along a top edge of the top horizontal profile in order to access the at least one of the serviceable components accommodated in the upper chamber.

According to another aspect, the cooling appliance comprises a French door bottom mount (FDBM) refrigerator appliance and the front frame having the four profiles and the four corner connecting pieces forms a front frame of the (FDBM) refrigerator appliance.

According to another aspect, a plurality of the front frames is provided with each having the four profiles and the four corner connecting pieces and each forming a corresponding front frame of one of multiple adjacent cooling appliances that are installed as a group at the customer's site.

BRIEF DESCRIPTION OF THE DRAWING FIGURES

The accompanying drawing figures incorporated in and forming a part of this specification illustrate several aspects of the invention, and together with the description serve to explain the principles of the invention.

FIG. 10 is a fragmentary, exploded perspective view showing a corner connecting piece connecting a horizontal profile and a vertical profile according to an exemplary embodiment consistent with present disclosure;

Figure 8C:
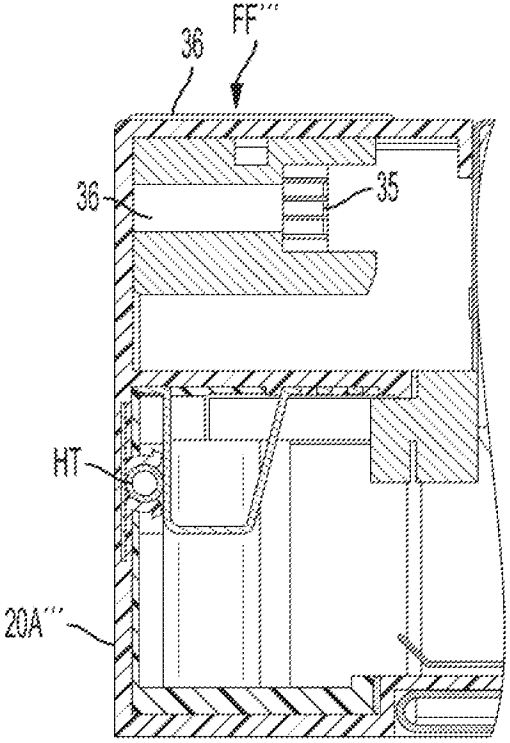
FIGS. 8A and 8B are perspective views of the reed switch holder and the door reed switch, respectively, according to an exemplary embodiment consistent with present disclosure.
Figure 9:
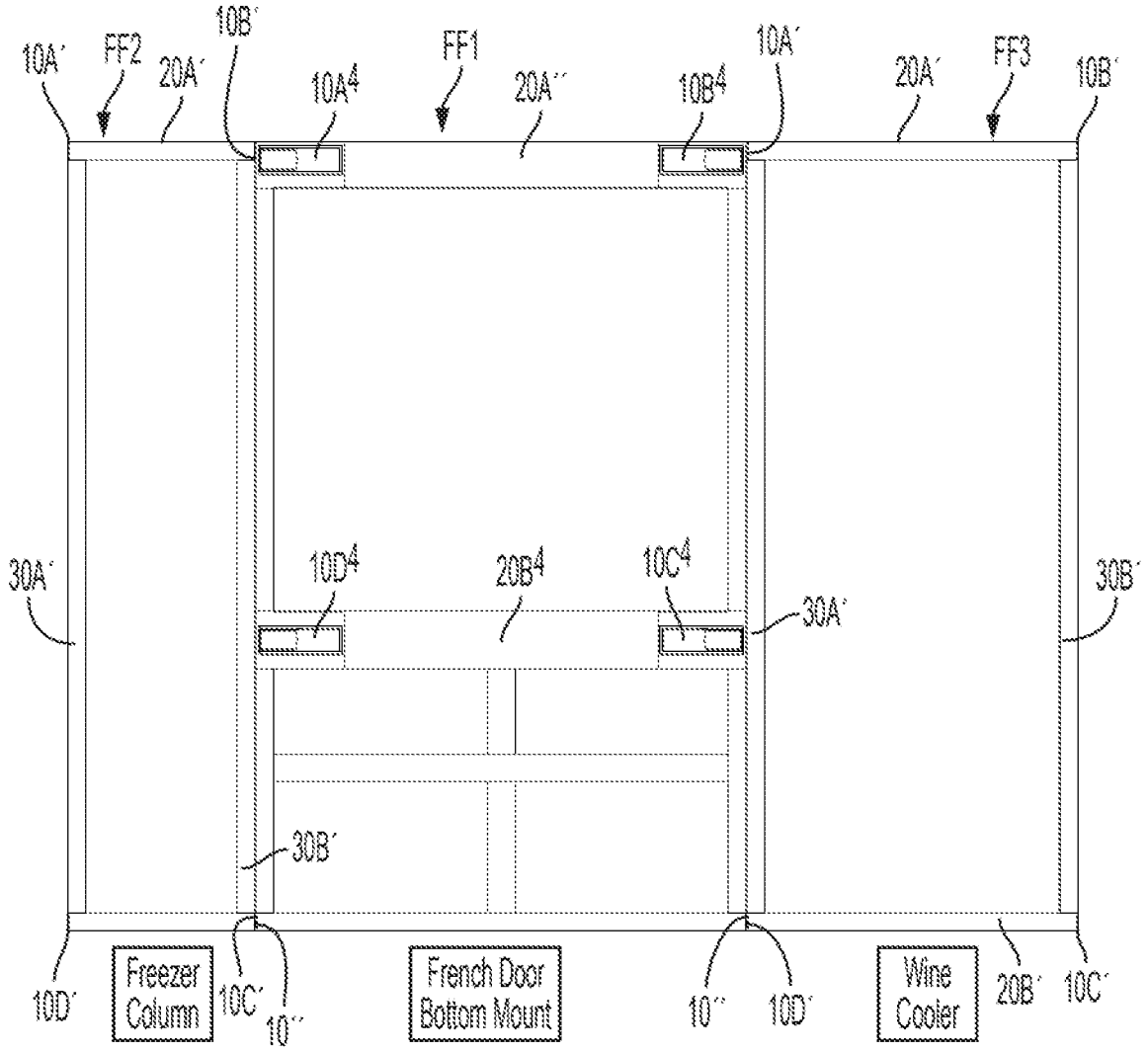

FIG. 8C is a detailed sectional view through a top horizontal profile showing the reed switch holder and the door reed switch according to an exemplary embodiment consistent with present disclosure; and FIG. 9 is a front view of multiple adjacent cooling appliances utilizing the hidden corner connecting pieces and horizontal and vertical profiles according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

The present application is related to application Ser. No. 16/750,021, entitled "EXTRUDED PLASTIC FRONT FRAME PROFILES FOR COOLING APPLIANCES," filed on an even date herewith, and the entire contents of which are incorporated herein by reference.

Figure 1A:
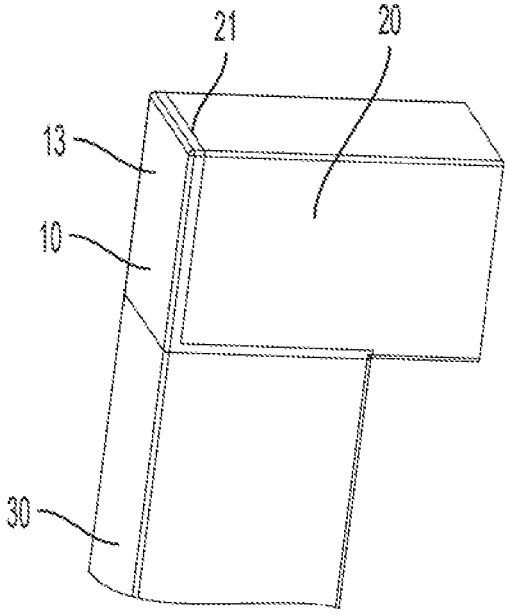
FIG. 1A is a fragmentary, front perspective view showing a corner connecting piece connecting a horizontal profile and a vertical profile according to an exemplary embodiment consistent with present disclosure.
Figure 1B:
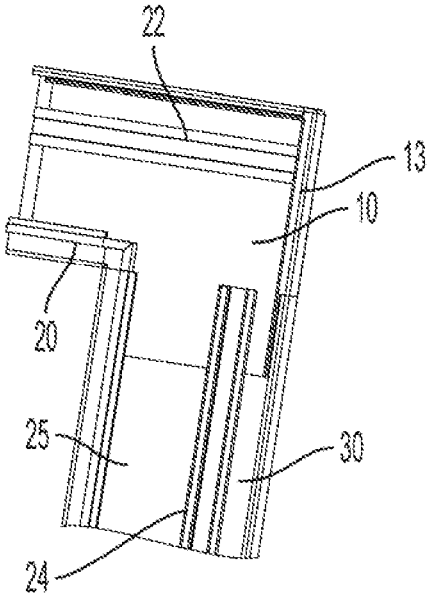
FIG. 1B is a fragmentary, rear perspective view showing a corner connecting piece connecting a horizontal profile and a vertical profile according to an exemplary embodiment consistent with present disclosure.
Figure 1C:
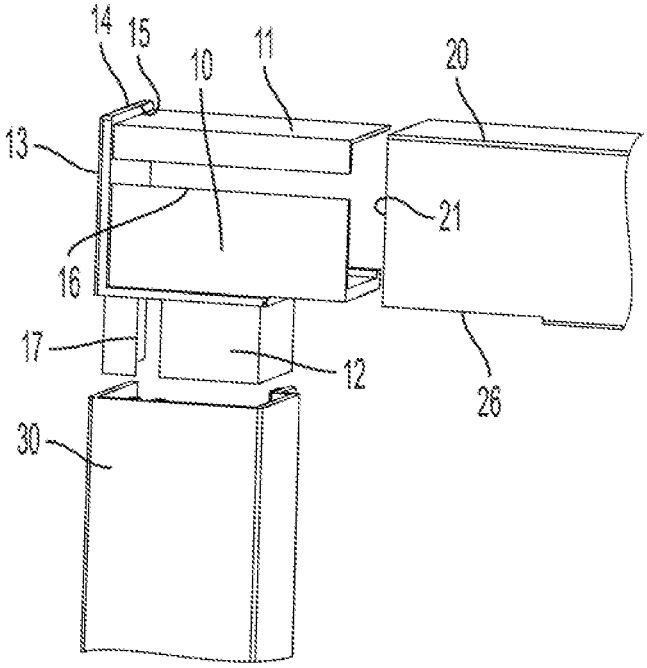
Figure 2:
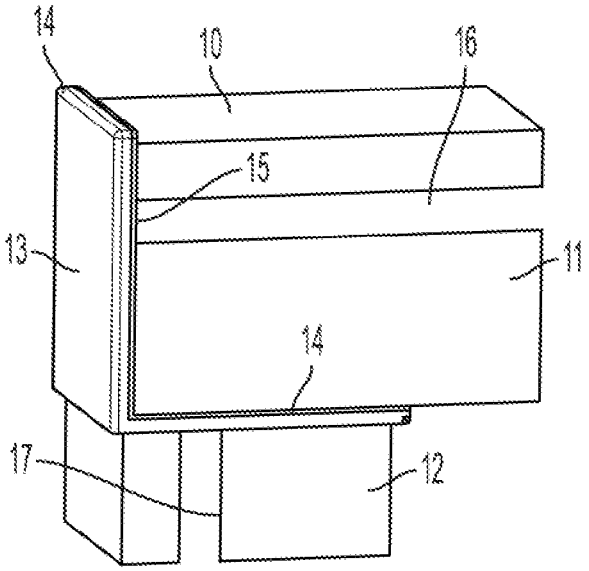
FIG. 2 is a perspective view showing a single corner connecting piece separately according to an exemplary embodiment consistent with present disclosure.
Figure 3:
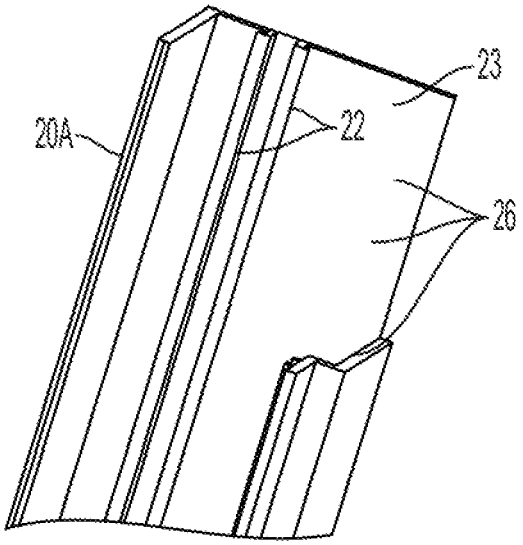
FIG. 3 is a fragmentary, rear perspective view showing a machining detail of a single profile according to an exemplary embodiment consistent with present disclosure.

FIGS. 1A, 1B, and 1C are front, rear, and exploded perspective views, respectively, showing a corner connecting piece 10 connecting a horizontal profile 20 and a vertical profile 30 (only fragmentary portions of which are shown) according to an exemplary embodiment consistent with present disclosure. FIG. 2 shows a single corner connecting piece 10 by itself, and FIG. 3 shows a machining detail of a single profile, such as a horizontal profile 20A, according to an exemplary embodiment consistent with present disclosure.

Figure 4:
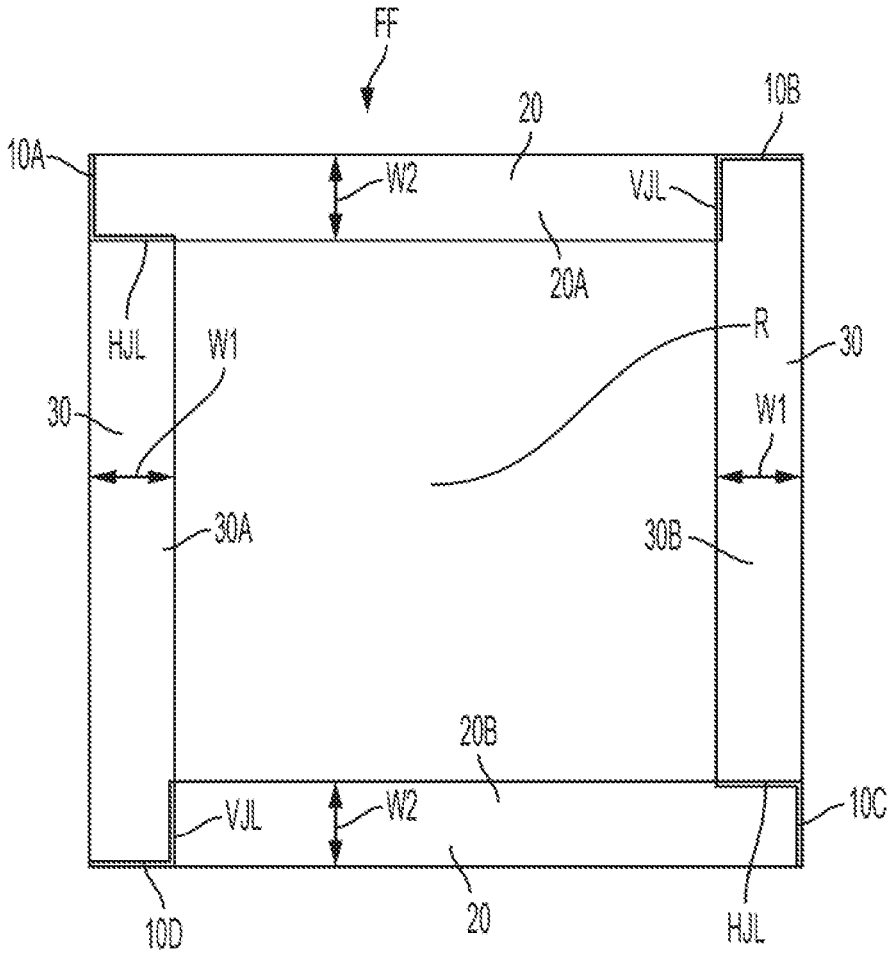
FIG. 4 is a front view of a complete refrigerator front frame having hidden corner connecting pieces and a mix of horizontal and vertical seams or joining lines according to an exemplary embodiment consistent with present disclosure.
Figure 7A:
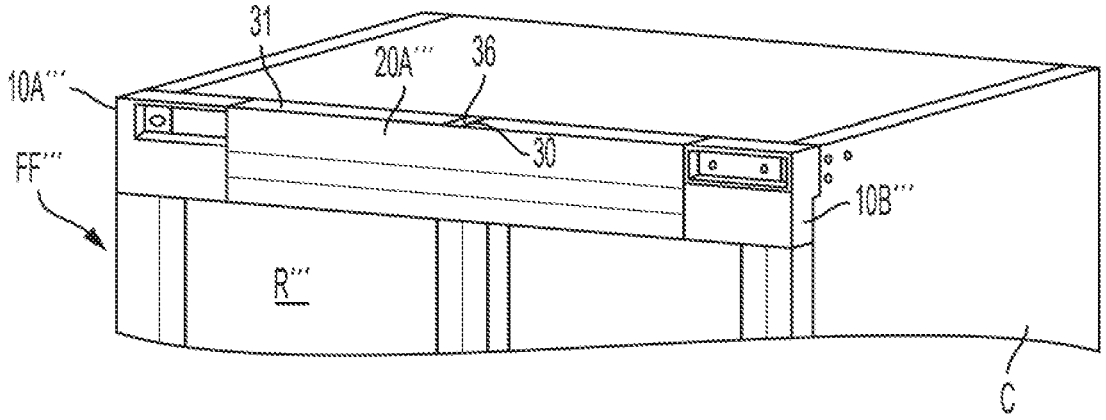
FIG. 7A is a front perspective view of a refrigerator front frame on a refrigerator/cooling appliance showing an access for a door reed switch according to an exemplary embodiment consistent with present disclosure.

With reference to FIG. 1C and FIG. 2, the corner connecting piece 10 comprises a horizontal receiving portion 11 configured to receive one of the horizontal profiles 20 thereover and a vertical receiving portion 12 configured to receive one of the vertical profiles 30 thereover. As will be discussed in detail below, four of the corner connecting pieces 10 are configured to join the four of the profiles 20, 30 to form a refrigerator front frame FF for a refrigerator appliance R as shown in FIG. 4 (also referred to as a front frame FF for a cooling appliance such as a refrigerator appliance R). The front frame FF is typically attached to a front side end portion of a structural casing or housing of the refrigerator appliance R (note that FIG. 7A shows the casing C of the refrigerator appliance).

As shown in FIG. 4, the four profiles 20, 30 comprising two vertical profiles 30A and 30B each having a first width W1 and two horizontal profiles 20A and 20B at least one of which has a second width W2, where the first width W1 and the second width W2 are different. Preferably, but not necessarily, the second width W2 of the at least one of the two horizontal profiles 20A and 20B is larger than the first width W1 of each of the two vertical profiles. At least one of the two horizontal profiles 20A and 20B is preferably the top horizontal profile 20A of the refrigerator front frame FF of the refrigerator appliance R, as the top horizontal profile 20A may be made wider to allow space for two chambers, as will be discussed in detail below.

With reference to FIGS. 1A-10 and 2, the horizontal receiving portion 11 of each of the corner connecting piece 10 includes an exposed end face 13 with a flange 14 that extends beyond the horizontal receiving portion 11 and serves as a stop 15 for the end 21 of a corresponding horizontal profile 20.

With reference again to FIGS. 10, 2, and 3, the horizontal receiving portion 11 of the corner connecting piece 10 includes an elongated slot 16 configured to slidably receive a corresponding rail 22 that projects from a rear surface 23 of a corresponding horizontal profile 20. The vertical receiving portion 12 of the corner connecting piece 10 includes an elongated slot 17 configured to slidably receive a corresponding rail 24 that projects from a rear surface 25 of a corresponding vertical profile 30.

As best shown in FIGS. 10 and 3, the side of one profile 20, 30 must be machined out before assembly in order to clear where the other attaches to the corner connecting piece 10. For example, a lower side of the top horizontal profile 20A is machined as at 26 to cut away a wall portion such that the top horizontal profile 20A is slidable over the vertical receiving portion 12 of a corresponding one of the four corner connecting pieces 10. This would also then be the case at an upper side of the bottom horizontal profile 20B which would need to be machined in order to clear where the vertical profiles 30A and 30B attach to the corner connecting pieces 10.

Preferably, each of the four corner connecting pieces 10 is an injection molded plastic corner connecting piece. The individual injection molded plastic corner connecting pieces 10 are preferably, but not necessarily, formed from acrylonitrile styrene acrylate (ASA) plastic. Preferably, each of the four profiles 20, 30 is a plastic extrusion profile formed by extruding a plastic such as, for example, an acrylonitrile styrene acrylate (ASA) plastic or an acrylonitrile butadiene styrene (ABS) plastic.

Referring to FIG. 4 again, a complete refrigerator front frame FF is provided having four hidden corner connecting pieces 10A, 10B, 100, and 10D and a mix of horizontal seams or joining lines HJL and vertical seams or joining lines VJL where the horizontal profiles 20A, 20B and vertical profiles 30A, 30B are joined together at the corners according to an exemplary embodiment consistent with present disclosure. This embodiment of mixed horizontal and vertical seams or joining lines is achieved by using the same injection molded corner connecting pieces 10 part at every corner. Note that the seam or joining line, whether horizontal HJL or vertical VJL, is a region where two profiles meet at a corner region of the refrigerator front frame FF, but where a small amount of the underlying and otherwise hidden corner connecting piece 10 is visible as a line from the front of the refrigerator front frame FF. A cooling or refrigerator appliance R having a refrigerator front frame FF where all four corner connecting pieces 10A-10D would be ones that have no hinges such as, but not limited to, an under-the-counter drawer type appliances.

With the above-described corner connecting pieces 10, a corner piece, which is mostly hidden behind the extruded profiles 20, 30, can be created. This creates a sleeker, slimmer appearance with gaps less visible. The corner connecting pieces 10 and extruded members 20, 30 are held relative to each other by an insulation foam that is injected into the walls and front frame FF of the cooling appliance R, but can also be fixed by other means such as sonic welding, posting, gluing, screwing, taping, riveting, etc., for additional strength.

Moreover, by using the above-described corner connecting pieces 10, wider horizontal profiles 20A can be used at the top than at the sides. Wider top profiles 20A allow space for two chambers. As will be described in more detail below, the lower chamber is foam-filled like the rest of the extruded profiles (side and bottom), whereas the upper chamber is hollow and allows space for various serviceable components.

Figure 5B:
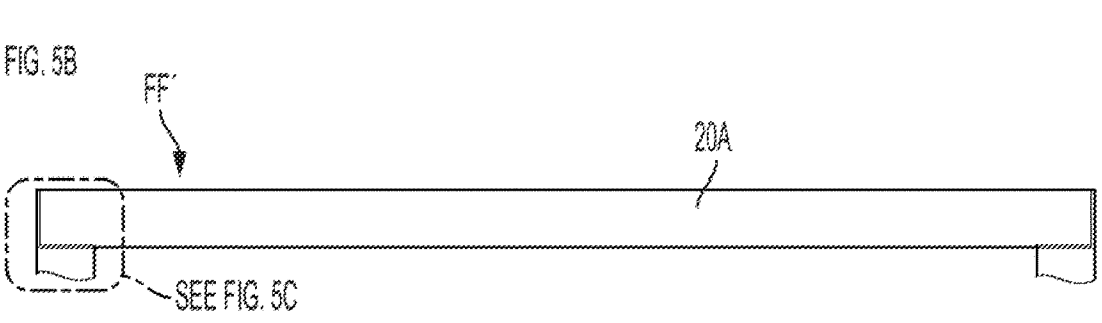
FIGS. 5B and 5C are various enlarged, fragmentary views of one of the corner connecting pieces of the refrigerator front frame having a horizontal seam or joining line according to an exemplary embodiment consistent with present disclosure.
Figure 5C:
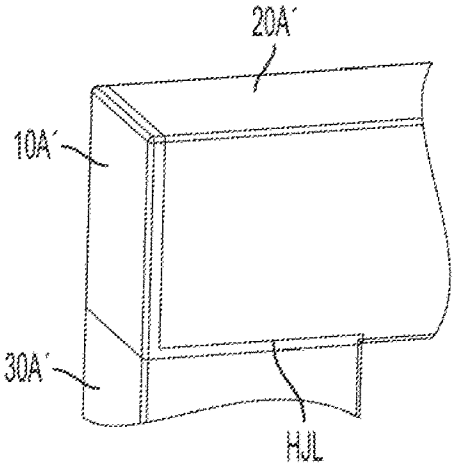
Figure 5A:
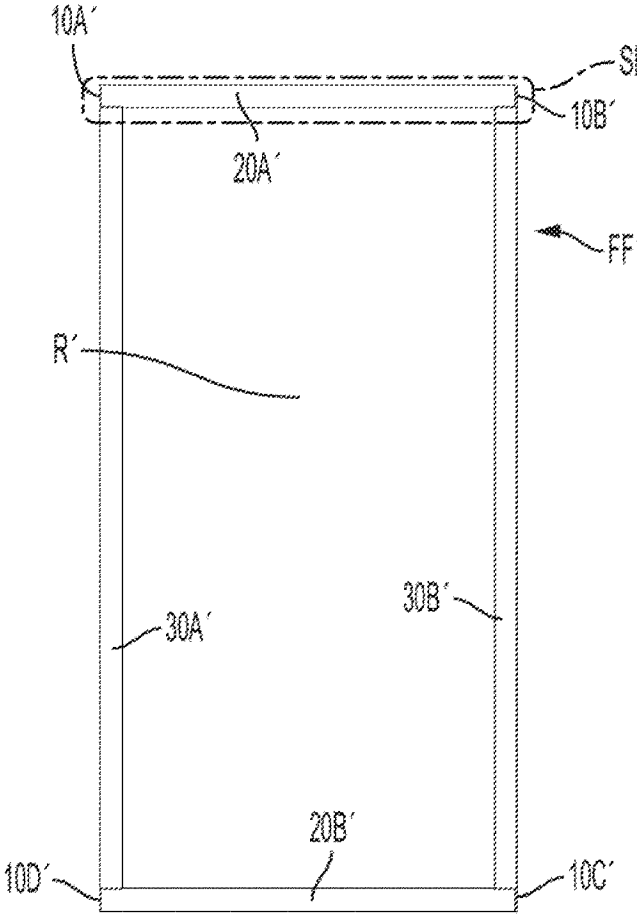
FIG. 5A is a front view of a complete refrigerator front frame having hidden corner connecting pieces and horizontal seams or joining lines according to an exemplary embodiment consistent with present disclosure.

FIGS. 5A-5C are various views of a complete refrigerator front frame FF' having hidden corner connecting pieces 10' and horizontal seams or joining lines HJL for a refrigerator appliance R' according to another exemplary embodiment consistent with present disclosure. Similar reference numbers are used to denote similar structure as in FIG. 4, except that a single prime sign (') is added next to the reference numeral. In this embodiment, left and right mirror image variants of the corner connecting pieces 10' are used such that all of the seams or joining lines are oriented the same way—in this case horizontal joining lines HJL in FIGS. 5A-5C. Of course, all four of the seams or joining lines could be oriented vertically (FIG. 4 shows two of the seams as vertical joining lines VJL).

Figure 6A:
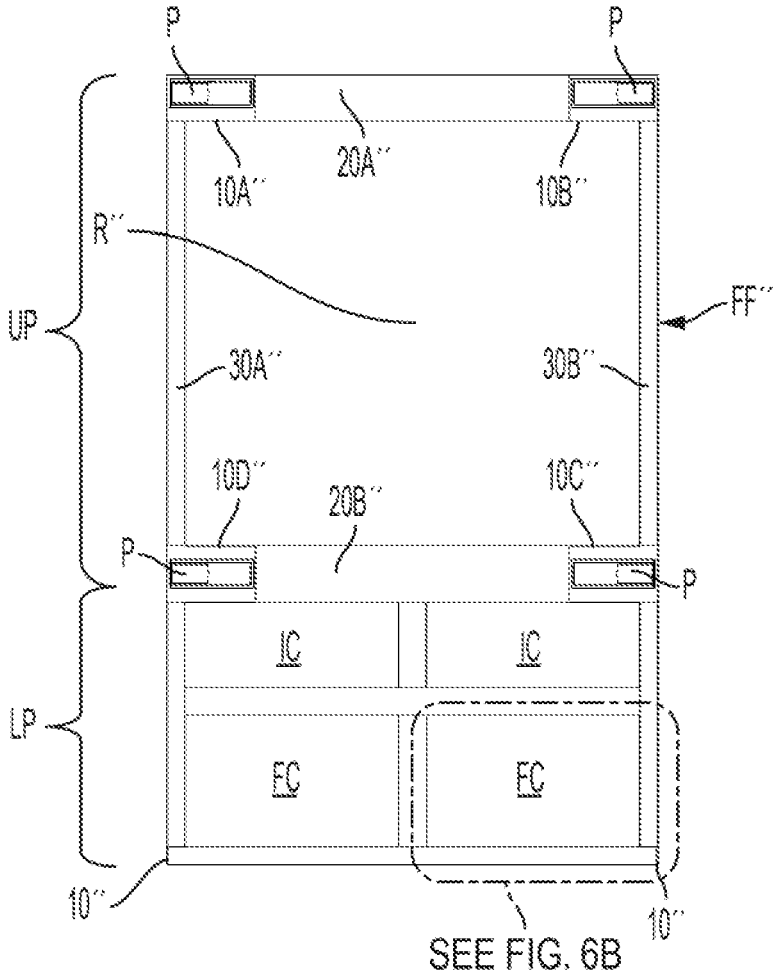
FIG. 6A is a front view of a refrigerator front frame for a French door bottom mount (FDBM) refrigerator appliance according to an exemplary embodiment consistent with present disclosure.
Figure 6B:
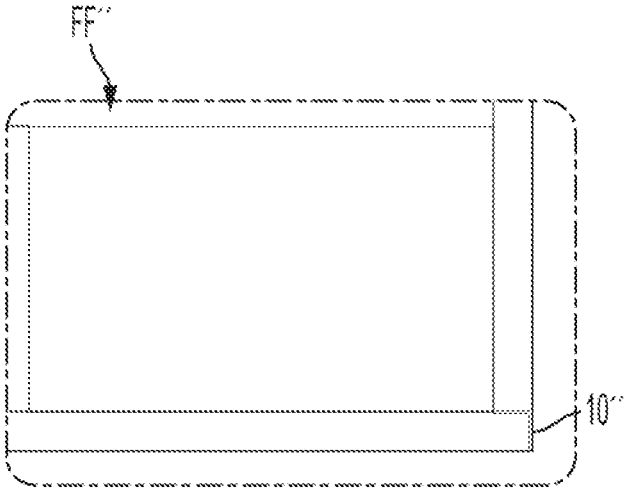
FIG. 6B is an enlarged view of a lower right hand corner portion of the refrigerator front frame of FIG. 6A according to an exemplary embodiment consistent with present disclosure.

FIG. 6A is a front view of a refrigerator front frame FF" for a French door bottom mount (FDBM) refrigerator appliance R", and FIG. 6B is an enlarged view of a lower right hand corner portion of the refrigerator front frame FF" of FIG. 6A according to another exemplary embodiment consistent with present disclosure. Similar reference numbers are used to denote similar structure as in FIG. 4, except that a double prime sign (") is added next to the reference numeral. In this embodiment, the upper and middle corner connecting pieces 10A", 10B", 100", and 10D" are not hidden but are revealed from the front because they incorporate hinge pockets P in order to reduce the amount of parts. The hinge pockets P are for hinges (not shown) for supporting the two French doors (not shown) at an upper, main fresh food portion UP of the FDBM refrigerator appliance R". A lower portion LP of the FDBM refrigerator appliance R" is configured to house one or more freezer compartments FC at the bottom that can be either a single or multiple pullout drawer type sections and one or more intermediate compartments IC (such as, but not limited to, pullout drawers) that can be operated as either fresh food compartments or freezer compartments and which are located between the upper, main fresh food portion UP and the freezer compartments FC. FIG. 6B shows a lower right hand portion of the FDBM refrigerator appliance R" that uses a hidden corner connecting piece 10". Both lower corner portions of the FDBM refrigerator appliance R" can use a hidden corner connecting piece 10".

Figure 7B:
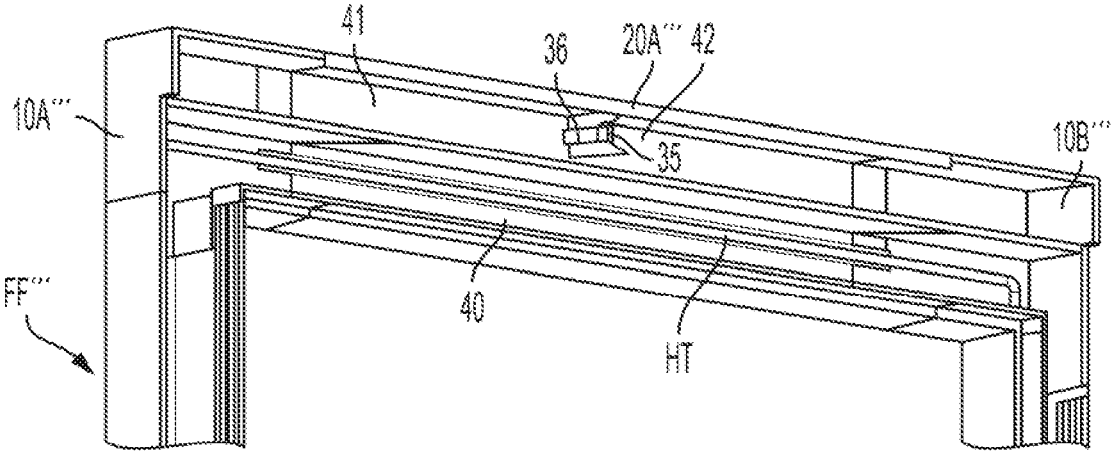
FIG. 7B is a rear perspective view of a refrigerator front frame showing a compartment for a door reed switch according to an exemplary embodiment consistent with present disclosure.

FIG. 7A is a front perspective view of a refrigerator front frame FF'" on a refrigerator/cooling appliance R'" showing an access opening 30 for a door reed switch 35 according to an exemplary embodiment consistent with present disclosure. Similar reference numbers are used to denote similar structure as in FIG. 4, except that a triple prime sign ("') is added next to the reference numeral. In particular, the top horizontal profile 20A'" has the access opening 30 at the top edge or surface 31 for receiving a reed switch holder 36 (see the rear perspective view of FIG. 7B). In this way, the reed switch holder 36 can be removed and the door reed switch 35 serviced from the top edge 31 of the top horizontal profile 20A'" of the refrigerator front frame FF'", so that no additional seams are necessary from a front view of the cooling appliance R'". As shown in FIG. 7B, the top horizontal profile 20A'" of the refrigerator front frame FF'" of the cooling appliance R'" is partitioned into a lower chamber 40 that is foam-filled, and an upper chamber 41 that is hollow. The lower chamber 40 accommodates a heating tube HT for distributing anti-condensation heat. In use, refrigerant with excess heat from the cooling cycle, for example, is passed through the heating tube HT to prevent condensation from forming at the front surface of the front frame FF. The upper chamber 41 serves as a compartment 42 for the door reed switch 35. In addition to accommodating the door reed switch 35, the upper chamber 41 is also configured to accommodate one or more of the following serviceable components: door hinges, a wiring harness, an ambient light sensor, an open door assist, or other serviceable components. Note that in this embodiment, the two top corner connecting pieces 10A'" and 10B'" are not hidden but are revealed from the front because they also incorporate the function of a hinge pocket P for hinges for supporting doors (not shown).

Figure 8B:
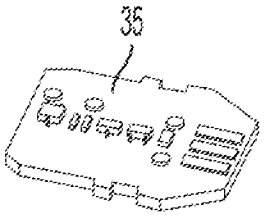
Figure 8A:
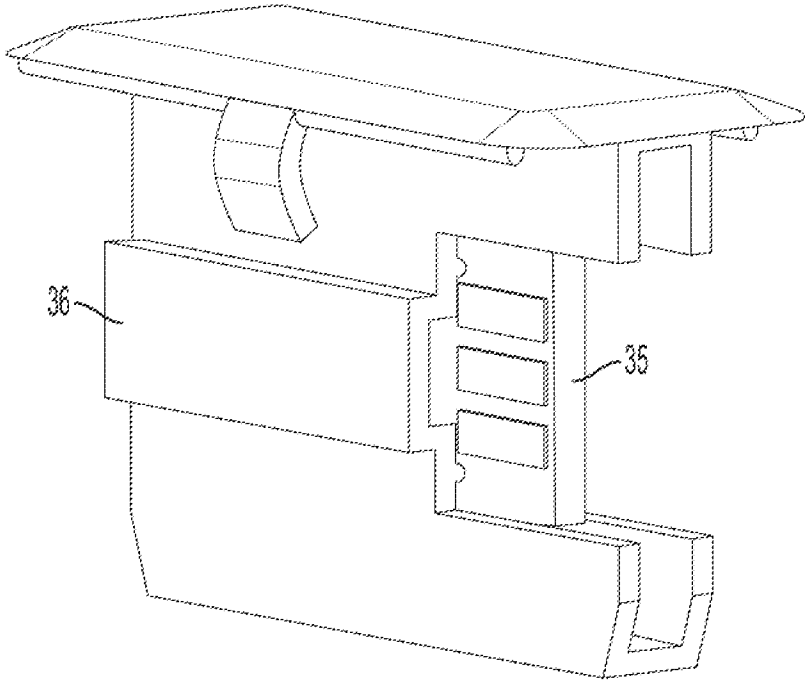

FIGS. 8A and 8B are perspective views of the reed switch holder 36 and the door reed switch 35, respectively, and FIG. 8C is a detailed sectional view through a top profile 20A'" showing the reed switch holder 36 and the door reed switch 35 in position within the refrigerator front frame FF". The door reed switch 35 is provided for sensing the opening and closing of the cooling appliance R'" door (not shown) by a user.

FIG. 9 is a front view of multiple adjacent cooling appliances utilizing the hidden corner connecting pieces and horizontal and vertical profiles according to an exemplary embodiment consistent with present disclosure. For example, but not limited thereto, the multiple adjacent cooling appliances can include an FDBM refrigerator appliance as shown and described in FIGS. 6A and 6B in the middle, with a freezer column appliance on one side and a wine cooler appliance on the other side. Each of the multiple appliances can use the hidden corner connecting pieces 10 where hinges are not required and the horizontal profiles (20A, 20B; 20A', 20B'; 20A", 20B"; 20A'", 20B'") and the vertical profiles (30A, 30B; 30A', 30B'; 30A", 30B"; 30A'", 30B'"). Preferably, the front frames FF1, FF2, and FF3 of each of the multiple adjacent cooling appliances should be one material all the way across, so that they are aesthetically pleasing when assembled as a group.

The present invention has substantial opportunity for variation without departing from the spirit or scope of the present invention. For example, while the front frame connecting corner pieces 10 are describe above with respect to the front frame FF of a cooling appliance such as a home or domestic refrigerator appliance, the front frame corner portions also have application for other home appliances, picture frames, window frames, door frames, TV frames, other display screen frames, and the like where the frame has different width vertical and horizontal members. Moreover, while FIGS. 6A, 6B, and 9 show a French door-bottom mount (FDBM) style refrigerator, the present invention can be utilized in a side-by-side refrigerator where the refrigerator compartment and the freezer compartment are disposed side-by-side in a vertical orientation, as well as in other well-known refrigerator and cooling appliance configurations such as, but not limited to, top freezer configurations, bottom freezer configurations, and the like. Still further, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A refrigerator front frame in a refrigerator appliance, comprising:

four profiles comprising two vertical profiles each having a length and a first width and two horizontal profiles each having a length and at least one of the two horizontal profiles has a second width, where the first width and the second width are different and where the first width is oriented in a left and right direction and the second width is oriented in an up and down direction when viewing the refrigerator front frame of the refrigerator appliance in a front view; and four corner connecting pieces configured to join the four profiles to form the refrigerator front frame, wherein each of the four corner connecting pieces comprises a horizontal receiving portion configured to receive one of the two horizontal profiles thereover and a vertical receiving portion configured to receive one of the two vertical profiles thereover, and wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view.

2. The refrigerator front frame of claim 1, wherein the second width of the at least one of the two horizontal profiles is larger than the first width of each of the two vertical profiles.

3. The refrigerator front frame of claim 1, wherein the at least one of the two horizontal profiles is a top horizontal profile of the refrigerator front frame of the refrigerator appliance.

4. The refrigerator front frame of claim 3, wherein the top horizontal profile of the refrigerator front frame of the refrigerator appliance is partitioned into a lower chamber that is foam-filled, and an upper chamber that is hollow to accommodate at least one serviceable component including a door switch.

5. The refrigerator front frame of claim 4, wherein the top horizontal profile of the refrigerator front frame of the refrigerator appliance includes at least one service access opening along a top edge of the top horizontal profile in order to access the at least one serviceable component accommodated in the upper chamber.

6. The refrigerator front frame of claim 1, wherein the horizontal receiving portion of each of the four corner connecting pieces includes an exposed end face with a flange that extends beyond the horizontal receiving portion and serves as a stop for the end of a corresponding horizontal profile, and wherein the exposed end face is exposed from an external side of the refrigerator front frame and the flange and the joining line are exposed from a front of the refrigerator front frame when viewing the refrigerator front frame of the refrigerator appliance in a front view.

7. The refrigerator front frame of claim 1, wherein the horizontal receiving portion of each of the four corner connecting pieces includes an elongated slot configured to slidably receive a corresponding rail that projects from a rear surface of a corresponding horizontal profile.

8. The refrigerator front frame of claim 1, wherein the vertical receiving portion of each of the four corner connecting pieces includes an elongated slot configured to slidably receive a corresponding rail that projects from a rear surface of a corresponding vertical profile.

9. The refrigerator front frame of claim 1, wherein the at least one of the two horizontal profiles is a top horizontal profile of the refrigerator front frame of the refrigerator appliance, and wherein a lower side of the top horizontal profile is machined such that the top horizontal profile is slidable over the vertical receiving portion of a corresponding one of the four corner connecting pieces.

10. The refrigerator front frame of claim 1, wherein each of the four corner connecting pieces is an injection molded plastic corner connecting piece.

11. The refrigerator front frame of claim 1, wherein each of the four profiles is a plastic extrusion profile.

12. A cooling appliance including a front frame, the front frame comprising:

four profiles comprising two vertical profiles each having a length and a first width and two horizontal profiles each having a length and at least one of the two horizontal profiles has a second width, where the first width and the second width are different and where the first width is oriented in a left and right direction and the second width is oriented in an up and down direction when viewing the refrigerator front frame of the cooling appliance in a front view; and four corner connecting pieces configured to join the four profiles to form a complete said front frame of the cooling appliance, wherein each of the four corner connecting pieces comprises a horizontal receiving portion configured to receive one of the two horizontal profiles thereover and a vertical receiving portion configured to receive one of the two vertical profiles thereover, and wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view.

13. The cooling appliance of claim 12, wherein the second width of the at least one of the two horizontal profiles is larger than the first width of each of the two vertical profiles.

14. The cooling appliance of claim 12, wherein the horizontal receiving portion of each of the four corner connecting pieces includes an exposed end face with a flange that extends beyond the horizontal receiving portion and serves as a stop for the end of a corresponding horizontal profile, and wherein the exposed end face is exposed from an external side of the front frame and the flange and the joining line are exposed from a front of the front frame when viewing the front frame of the cooling appliance in a front view.

15. The cooling appliance of claim 12, wherein the horizontal receiving portion of each of the four corner connecting pieces includes an elongated slot configured to slidably receive a corresponding rail that projects from a rear surface of a corresponding horizontal profile.

16. The cooling appliance of claim 12, wherein the vertical receiving portion of each of the four corner connecting pieces includes an elongated slot configured to slidably receive a corresponding rail that projects from a rear surface of a corresponding vertical profile.

17. The cooling appliance of claim 12, wherein each of the four corner connecting pieces is an injection molded plastic corner connecting piece.

18. The cooling appliance of claim 12, wherein each of the four profiles is a plastic extrusion profile.

19. The cooling appliance of claim 12, wherein the at least one of the two horizontal profiles is a top horizontal profile of the front frame of the cooling appliance, and wherein the top horizontal profile of the front frame of the cooling appliance is partitioned into a lower chamber that is foam-filled, and an upper chamber that is hollow to accommodate at least one serviceable component including a door switch.

20. The cooling appliance of claim 19, wherein the top horizontal profile of the front frame of the cooling appliance includes at least one service access opening along a top edge of the top horizontal profile in order to access the at least one serviceable component accommodated in the upper chamber.

21. The cooling appliance of claim 12, wherein the cooling appliance comprises a French door bottom mount (FDBM) refrigerator appliance and the front frame having the four profiles and the four corner connecting pieces forms a front frame of the (FDBM) refrigerator appliance.

22. The cooling appliance of claim 12, further comprising a plurality of the front frames each having the four profiles and the four corner connecting pieces and each forming a corresponding front frame of one of multiple adjacent cooling appliances which are assembled as a group.

23. A refrigerator front frame for a refrigerator appliance, comprising:

four profiles comprising two vertical profiles each having a first width and two horizontal profiles at least one of which has a second width, where the first width and the second width are different; and four corner connecting pieces configured to join the four profiles to form the refrigerator front frame, wherein each of the four corner connecting pieces comprises a horizontal receiving portion configured to receive one of the two horizontal profiles thereover and a vertical receiving portion configured to receive one of the two vertical profiles thereover, wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view, wherein the at least one of the two horizontal profiles is a top horizontal profile of the refrigerator front frame of the refrigerator appliance, and wherein the top horizontal profile of the refrigerator front frame of the refrigerator appliance is partitioned into a lower chamber that is foam-filled, and an upper chamber that is hollow to accommodate at least one serviceable component including a door switch.

24. A cooling appliance including a front frame, the front frame comprising:

four profiles comprising two vertical profiles each having a first width and two horizontal profiles at least one of which has a second width, where the first width and the second width are different; and four corner connecting pieces configured to join the four profiles to form a complete said front frame of the cooling appliance, wherein each of the four corner connecting pieces comprises a horizontal receiving portion configured to receive one of the two horizontal profiles thereover and a vertical receiving portion configured to receive one of the two vertical profiles thereover, wherein ends of the two vertical profiles abut against sides of the two horizontal profiles or vice versa, such that a joining line between each of the two vertical profiles and each of the two horizontal profiles is either horizontal or vertical, and such that each of the four corner connecting pieces is substantially covered and thus hidden from view, and wherein the at least one of the two horizontal profiles is a top horizontal profile of the front frame of the cooling appliance, and wherein the top horizontal profile of the front frame of the cooling appliance is partitioned into a lower chamber that is foam-filled, and an upper chamber that is hollow to accommodate at least one serviceable component including a door switch.

* * * * *